United States Patent [19]

Eriksen

[11] Patent Number: 4,495,714

[45] Date of Patent: Jan. 29, 1985

[54] ASSEMBLY FOR HEAT TREATMENT OF A PAPERMAKING WIRE OR FELT

[75] Inventor: Günnar Eriksen, Asker, Norway

[73] Assignee: Thune-Eureka A/S, Tranby, Norway

[21] Appl. No.: 484,609

[22] Filed: Apr. 13, 1983

[30] Foreign Application Priority Data

Apr. 13, 1982 [NO] Norway ..... 821205

[51] Int. Cl.[3] ..... F26B 13/02

[52] U.S. Cl. ..... 34/111; 34/116; 34/123; 34/146; 38/71; 162/359

[58] Field of Search ..... 26/106; 28/142; 162/271, 273, 274, 358, 359, 197, 361, 199, 200; 38/70, 71; 34/143, 144, 146, 111, 116, 123

[56] References Cited

FOREIGN PATENT DOCUMENTS 762146 4/1934 France ..... 34/144

985744 7/1951 France ..... 34/144

*Primary Examiner*—Larry I. Schwartz

*Attorney, Agent, or Firm*—Young & Thompson

[57] ABSTRACT

An assembly for heat treatment of a papermaking wire or felt comprises mutually opposing heating surfaces that are alternately offset in the direction of web travel and can be moved toward the felt/wire, thereby enabling one to obtain an ironing effect on both sides of the web simultaneously. The heating surfaces may constitute parts of respective box members whose interiors are formed for being heated by a heat medium, for example, hot oil.

7 Claims, 4 Drawing Figures

ASSEMBLY FOR HEAT TREATMENT OF A PAPERMAKING WIRE OR FELT

Figure 1:
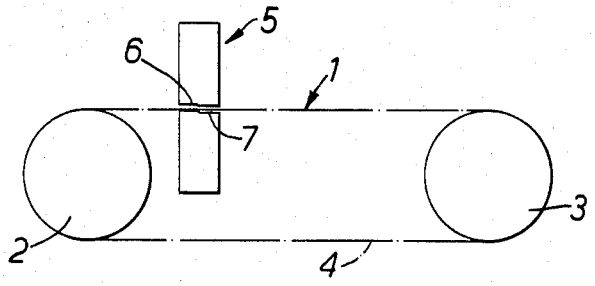

The invention relates to an assembly for heat treatment of a papermaking wire or felt.

Wires and felts used in papermaking machines are subjected to special treatment in equipment for stretching and fixing the felt/wire. Such stretching and fixing apparatus may comprise several different treatment units. Heat treatment of the felt or wire in such an apparatus may be carried out by causing the felt/web to pass between heater rolls, or by blowing hot air toward the felt.

The invention proposes treating the felt or wire on both sides of the web simultaneously by means of mutually opposing heating surfaces which can be moved toward each other and which are alternately offset in the direction of web travel. In this way, the felt/wire is subjected to both heat and pressure by surface contact, thereby enabling one to obtain an ironing effect on both sides of the felt simultaneously. The advantage of the alternately offset heating surfaces is that the tolerances do not have to be as close as is the case for a roller nip.

The assembly can be installed in existing machines and requires no complicated supports and heating systems, as rollers do. Preferably, the assembly is made such that each heating surface is formed by a wall of a box member, and the wall surface facing toward the interior of the box member is formed for contact with a heat medium. The box configuration provides a lightweight and self-supporting structure, which is of advantage since the web width may be up to several meters wide.

When the assembly comprises such box members, each box member is preferably formed as a hollow cross section I-beam, the offset heating surface then being disposed on an outer flange wall. An I-beam is an advantageous construction which is quite strong, and it will not warp if the entire beam is hollow and is heated with a heat medium which passes through the entire hollow beam. The box member which is formed as a hollow cross section I-beam can be subdivided by transverse partitions into two respective flange cavities and a stem cavity, the cavities being connected at one end of the box member to an inlet/outlet for the heating medium and at the other end of the box member having a mutual flow connection for the medium.

The heat medium is brought into contact with both flange regions in this manner, so that the flange regions are heated equally to prevent the beam from warping. It is naturally possible to utilize a plurality of pairs of heating surfaces, arranged one after the next in the direction of the web. These pairs of heating surfaces can be formed as parts of one structural unit on respective sides of the web surface, or several units may be assembled side by side, spaced apart as desired along the direction of web travel.

The heating surfaces—or the structural units, for example said box members, by which the heating surfaces are supported or of which the surfaces constitute a part—can be arranged or mounted in many ways to enable the surfaces to be moved together or the slot width between them to be adjusted as required.

According to the invention, the lower heating surface, for instance, may rest upon compressed air-actuated or motor-driven jacks, for adjusting the height of the lower heating surface. The upper heating surface may be stationary, capable of being raised and lowered, or upwardly pivotable about a point at one edge of the web.

Figure 2:
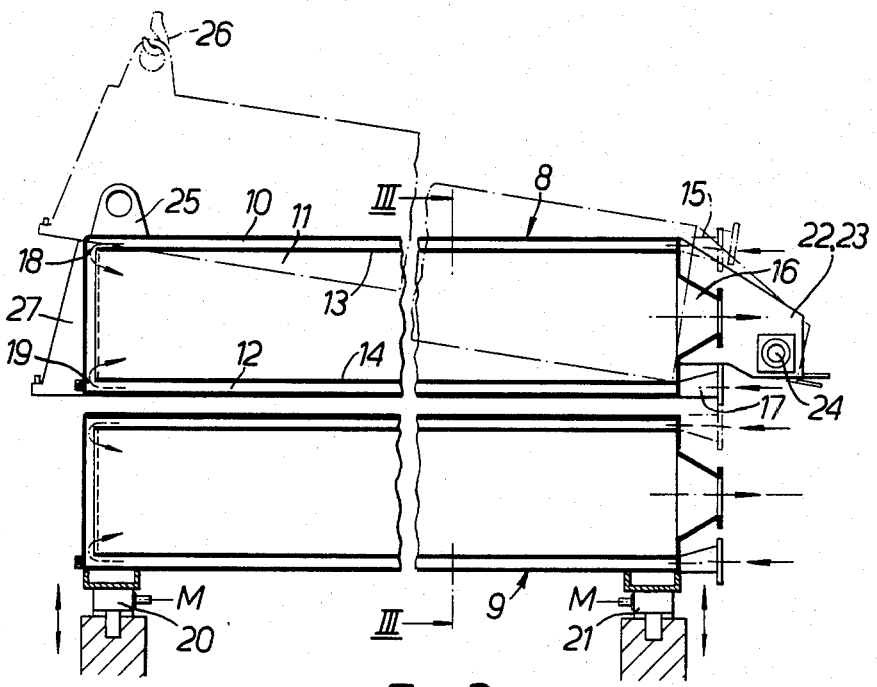
Figure 3:
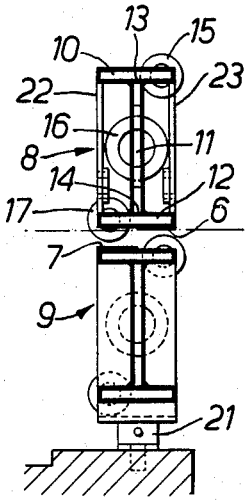
Figure 4:
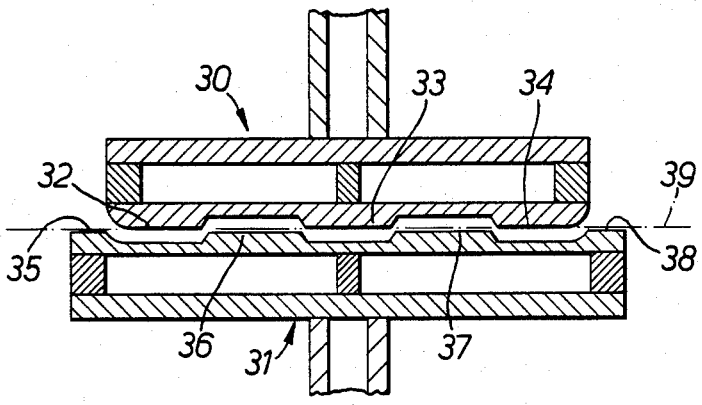

The invention will be explained in greater detail in the following with reference to the accompanying drawings wherein:

FIG. 1 illustrates, in purely schematic manner, an assembly in accordance with the invention in a stretching and fixing apparatus for felts or wires, FIG. 2 is a longitudinal section through the two box members shown in FIG. 1 which form the assembly, FIG. 3 is a cross section along the line III—III in FIG. 2, and FIG. 4 shows a modified embodiment of the invention.

All of the drawings are schematic in nature and show only those members which are necessary in order to understand the invention.

FIG. 1 shows a stretching and fixing apparatus 1, merely suggested in the drawing by two tensioning rolls 2 and 3 with a felt or wire 4 wrapped around the rolls. An assembly 5 in accordance with the invention is shown in FIG. 1 as two mutually opposing heating surfaces 6,7 which may be brought into contact with the felt/wire 4. As the Figure shows, the heating surfaces are offset in the direction of web travel.

The offset heating surfaces 6 and 7 may be heated in any desired manner, and they can be pressed toward each other, e.g., the lower heating surface 7 can be raised and lowered in relation to the upper, upwardly pivotal heating surface 6.

A preferred embodiment of the assembly is shown in FIGS. 2 and 3, where it may be seen that the two offset heating surfaces 6 and 7 are disposed on respective, facing outer flange walls of respective hollow cross section I-beams 8 and 9.

The upper I-beam or box member 8 is divided into three separate cavities 10, 11, 12 in the longitudinal direction of the box member by means of transverse partitions 13 and 14. The box member, in other words, is formed as a hollow cross section I-beam with separate flange cavities 10,12 and a cavity in the stem of the I. Each of these cavities is connected at one end of the box members to respective conduit members 15,16,17. At the other end of the box member, the three cavities 10, 11, 12 are in flow communication at 18 and 19.

In the illustrated example, heat medium is introduced into the cavities through the two inlets 15 and 17, which open into the respective flange cavities 10 and 12, and the heat medium exits from the outlet 16 which is connected to the stem cavity 11.

This special way of guiding the flow of heat medium through the box member provides uniform heating of the box member.

The offset heating surface 6 may be provided, for example, by welding a plate of one-half flange width onto the flange wall, but the offset configuration could also be provided by bending or forming a jog in the outer flange plate. Machining is the preferred method, however, i.e., machining off part of the material.

The lower box member 9 is similarly constructed, and the heat medium is caused to flow through this box member in the same manner as in the above-described box member 8.

The lower box member 9 is supported on two jacks 20, 21 to permit its height to be adjusted as required.

The upper box member 8 is provided at one end thereof with two outwardly projecting brackets 22 and 23, by means of which it is pivotally mounted on a journal 24 provided on a support member which is not shown in the drawing. At the other end, the box member 8 has a lifting lug 25. By means of a crane (not shown) whose hook is sketched in at 26, the box member 8 can be pivoted upwardly as shown to facilitate the introduction and removal of the felt/wire. The bracket 27 serves to secure the box member 8 in the operative position, in a manner not illustrated in the drawing. When the upper box member 8 has been pivoted down into the operative position and its position locked by the bracket 27, the slot width between the upper and lower box members can be adjusted by raising or lowering the lower box member 9 with the aid of the jacks 20, 21. These jacks may be of any suitable type, for example, compressed air-actuated bellows.

Although the embodiment shown and described above is a preferred embodiment, the invention's idea can be realized in many ways. In particular, a plurality of consecutive or interconnected heating surfaces could be arranged above and below the felt/wire. FIG. 4 shows, in a strictly schematic manner, how several heating surfaces can be placed side by side as parts of one structural unit. The unit may in principle consist of box members 30, 31 having the same general construction as the box members 8 and 9 in FIGS. 1–3, with several heating surfaces 32, 33, 34 and 35, 36, 37, 38 for treating the web 39.

Other structural embodiments and solutions could also be utilized, which the skilled person can easily derive on the basis of the inventive idea described herein. For instance, the heating surfaces and their support structures could be arranged to be raised and lowered in suitable machine support stands.

Oil is preferably utilized as a heat medium.

Having described my invention, I claim:

1. An assembly for heat treatment of travelling papermaking wire or felt, comprising mutually opposing heating surfaces, which are stationary when the travelling wire or felt moves between them but which may be moved together toward the felt/wire said heating surfaces being alternately offset with respect to the opposing heating surface toward and away from the felt/wire in the direction of travel of the felt/wire.

2. An assembly according to claim 1, characterized in that each offset heating surface is one wall of a box member and is formed for contact with a heat medium on the wall surface facing toward the interior of the box member.

3. An assembly according to claim 2, characterized in that the box member is formed as a hollow cross section I-beam with the offset heating surfaces disposed on one outer flange wall of the beam, the length of the I-beam being disposed horizontally and perpendicular to the directions of travel of the felt/wire.

4. An assembly according to claim 3, characterized in that the box member that is formed as an I-beam of hollow cross section is divided by partitions into respective flange cavities and a stem cavity, the cavities being connected at one end of the box member to inlet/outlet members for the heat medium, and having mutual flow connection for the heat medium at the other end of the box member.

5. An assembly according to claim 2, characterized in that one box member is supported by members for adjusting the height of one box member, whereas the opposing box member is adapted to be fixed in an operative position.

6. An assembly according to claim 5, characterized in that said opposing box member is supported on a horizontal journal at one end thereof.

7. An apparatus for heat treatment of a travelling papermaking wire or felt, comprising two box members disposed on opposite sides of the felt/wire, each said box member having a heating surface formed by a wall of the box member adjacent the felt/wire, means for bringing a heating medium into contact with each said wall, each said heating surface having stepped portions offset from each other and from the stepped portions of the opposing heating surface toward and away from the felt/wire in the direction of travel of the felt/wire and means for moving said walls toward and away from each other so as to contact and thereby heat the wire or felt.

* * * * *